US005354383A

United States Patent [19]

Bianchi

[11] Patent Number: 5,354,383

[45] Date of Patent: Oct. 11, 1994

[54] PROCESS FOR PICKLING AND PASSIVATING STAINLESS STEEL WITHOUT USING NITRIC ACID

[75] Inventor: Marco Bianchi, Milan, Italy

[73] Assignee: ITB, S.r.l., Milan, Italy

[21] Appl. No.: 2,942

[22] Filed: Jan. 11, 1993

Related U.S. Application Data

[63] Continuation-in-part of Ser. No. 770,632, Oct. 3, 1991, abandoned.

[30] Foreign Application Priority Data

Mar. 29, 1991 [IT] Italy ..... MI 91 A 000879

[51] Int. Cl.[5] ..... C23G 1/02

[52] U.S. Cl. ..... 134/3; 134/41; 252/79.3

[58] Field of Search ..... 134/3, 2, 41; 252/79.3

[56] References Cited

U.S. PATENT DOCUMENTS 4,100,014 7/1978 Kuhn-Kuhnenfeld ..... 156/647

FOREIGN PATENT DOCUMENTS 2551465 9/1983 France ..... 252/79.3
1165783 6/1989 Japan ..... 252/79.3
2000196 1/1979 United Kingdom .
9105079 4/1991 World Int. Prop. O. .

OTHER PUBLICATIONS

Robert C. Weast "Handbook of Chemistry and Physics" (1976–1977) 57th Edition p. D135.

*Primary Examiner*—Asok Pal
*Attorney, Agent, or Firm*—Hedman, Gibson & Costigan

[57] ABSTRACT

A process for pickling and passivating stainless steel using a bath of the following initial composition:

$H_2SO_4$ at least 150 g/l
$Fe^{3+}$ at least 15 g/l
HF at least 40 g/l
stabilized $H_2O_2$ 1–20 g/l
non-ionic surfactants and acid attack inhibitors 1 g/l, into which an air flow and an $H_2O_2$ quantity of between 0.3 and 1 g/l per hour, controlled to maintain the bath Redox potential at $\geqq 350$ mV, are fed in continuously.

5 Claims, No Drawings

PROCESS FOR PICKLING AND PASSIVATING STAINLESS STEEL WITHOUT USING NITRIC ACID

This application is a continuation-in-part of application Ser. No. 07/770,632 filed Oct. 03, 1991, now abandoned.

TECHNICAL PROBLEM

During the manufacture of hot-rolled steel products or of intermediate products undergoing heat treatment such as annealing, it is well known that the material becomes covered with a layer of oxidation products of varying thickness. Because of the need to obtain a bright surface finish for the final product, these oxide layers have to be totally removed. This is achieved by the well known pickling processes, for which inorganic mineral acids such as hydrochloric, sulphuric, nitric and hydrofluoric acids are used, either alone or in mixtures of varying proportions.

In the stainless steel field, based on a knowledge of currently used industrial processes the pickling process most commonly or indeed almost exclusively used involves the use of a mixture of nitric acid and hydrofluoric acid, the mutual concentrations of which vary according to the type of plant, the type of steel to be pickled, its surface characteristics and the geometry of the article to be treated. The process is without doubt economical and enables excellent results to be obtained. It has however the very serious drawback of creating considerable problems of an ecological nature which are difficult to solve, precisely because of the use of nitric acid. In this respect, nitrogen oxide vapours of general formula $NO_x$ are emitted into the atmosphere, these being highly polluting and aggressive towards metals and non-metals with which they come into contact, and in addition high nitrate levels are attained in the wash water and in the spent baths, with the consequent problem of their disposal. The elimination of the $NO_x$ vapours in the air and of the nitrates in spent baths creates considerable plant problems (for example at the moment there is no $NO_x$ treatment method which is technically free of problems), high running costs and no certainty that the results will satisfy current regulations. Thus in the final analysis the cost in terms of investment is difficult to sustain in most industrial plants. A pickling system which does not involve the use of nitric acid is therefore of considerable industrial interest and various proposals have been advanced in this respect throughout the world, especially during the last ten years.

Processes Aternative to the use of Nitric Acid: State of the Art

A search carried out of patents relating to nitric acid-free cycles proposed as an alternative to the traditional stainless steel pickling process based on $HNO_3+HF$ and of the main technical literature on this subject has brought to light the following:

A) Japanese patent JP 50071524 (Derwent Abstract) published on Jun. 13, 1975 uses a system consisting of hydrochloric acid and ferric chloride at a temperature of 70° C. and a treatment time of 20 seconds;

B) the two Japanese patents JP 55018552 (Derwent Abstract) published on Feb. 8, 1980 and JP 55050468 (Derwent Abstract) published on Apr. 12, 1980 comprise three stages, namely: 1) an initial descaling in sulphuric or hydrochloric acid, 2) subsequent immersion firstly in a solution of potassium permanganate and inorganic acids (not HF) and secondly in a solution of ferric nitrate, ferric sulphate and peroxydisulphuric acid, and 3) final washing with pressurized water or ultrasound;

C) Swedish patent SE 8001911 (Derwent Abstract) published on Oct. 12, 1981 describes treatment, for a time of between 1 and 120 minutes (1–20 rains preferred) at a temperature of between 10° and 90° C. (30°–60° C. preferred), in a solution formed from sulphuric acid and hydrogen peroxide:

D) German patent DD 244362 (Derwent Abstract) published on Apr. 1, 1987 uses at 15°–30° C. a solution formed from chromic acid, sulphuric acid, hydrofluoric acid and an inhibitor (hexamethylenetetramine); the bath is then neutralized with calcium and barium salts;

E) German patent DE 3937438 (Derwent Abstract) published on Aug. 30, 1980 is mainly directed towards the wire processing industry and uses a hydrofluoric acid solution containing $Fe^{3+}$ added in the form of a fluoride complex; an oxygenated gas and/or fluid medium is then added to the solution to be subjected to an electrolysis process to obtain nascent oxygen able to oxidize the bivalent iron to trivalent;

F) German patent DE 3222532 (Derwent Abstract) published on Dec. 22, 1983 describes the pickling of austenitic steel pipes or vessels, the internal surfaces of which are treated at 15°–30° C. with a solution formed from hydrofluoric acid and peroxides (either stabilized hydrogen peroxide or sodium perborate or organic peroxides not further identified), whereas the external surfaces are pickled with pastes formed from hydrofluoric acid, peroxides and fillers (carboxy-methylcellulose); the pastes have to be disposed of by neutralization with calcium salts, the peroxides being destroyed either by catalysts or by heating;

G) British patent 2,000,196 of TOKAI Denka Kogyo uses a pickling bath consisting of ferric sulphate and hydrofluoric acid. $H_2SO_4$ and hydrogen peroxide in a 1:1 molar ratio are fed continuously to maintain an adequate ferric ion concentration during the process. The method for controlling the process by continuously measuring the Redox potential of the system is also claimed, this having to be maintained at $\geqq 300$ mV by controlling the feed of $H_2SO_4+H_2O_2$;

H) two very similar patents U.S. Pat. No. 5,154,774 and EP 236354 (=WO 87/01739) use a pickling solution consisting of hydrofluoric acid (5–50 g/l) and a trivalent ferric ion introduced in the form of fluorinated complexes, into which air or oxygen is continuously blown; the treatment time is between 30 seconds and 5 minutes and the temperature varies from 10° C. to 70° C.; it is also recommended to continuously control the Redox potential, which has to be maintained between −200 and +800 mV for the first patent and between +100 mV and +300 mV for the second patent, adding an oxidant such as potassium permanganate or hydrogen peroxide to raise the potential if necessary. All the tests carried out relate only to pickling steel sheet, without using oxidizing compounds other than atmospheric air.

Finally, there are two further patents relating to the possibility of preventing or reducing to a minimum the formation of $NO_x$ nitrogen oxides in baths operating with nitric acid, by directly feeding suitable oxidants into the pickling bath. The first, Japanese JP 58110682 of Jul. 1, 1983 (Derwent Abstract), uses hydrogen peroxide; the other, Swedish SE 8305648 of Apr. 15, 1985 (Derwent Abstract), priority date Oct. 14, 1983, again uses hydrogen peroxide and/or alternatively urea.

Notwithstanding this proliferation of patents, until to-day the traditional process based on nitric acid and hydrofluoric acid is still widely used throughout the world and none of the aforesaid proposed alternatives have been accepted industrially.

Process of the Invention

The process according to the present patent application has shown brilliant results both in laboratory tests and, in particular, in industrial trials carried out on high-production lines and plants, and is undoubtedly superior to all previous proposals. It incorporates interesting aspects of certain of these proposals, which are rationalized into an overall and exhaustive project to which various aspects of absolutely novel character are added. The process is based on the use of a pickling bath containing ferric ions, $H_2SO_4$, HF, $H_2O_2$ and conventional additives such as wetting agents, emulsifiers, brighteners and anticorrosives, into which a strong air flow is continuously blown. The operating temperature is generally between 30° and 70° C. and preferably between 45° and 55° C. The basic characteristics of the process are as follows:

Inorganic mineral acid content of the bath: on preparing the pickling bath a solution is prepared containing at least 150 g/l and preferably about 170 g/l of $H_2SO_4$, and at least 40 g/l and preferably about 50 g/l of HF. These acids have various functions, of which the most important are to maintain the process pH at less than 1 and preferably between 0 and 0.5, to solubilize the oxides originating from the heat treatment, and, in the case of the hydrofluoric acid, to complex the $Fe^{3+}$ and $Cr^{3+}$ ions to the maximum extent.

As the concentrations of the two acids, and particularly the hydrofluoric acid, tend to fall during the pickling process, they have to be fed periodically on the basis of the bath analysis (free acid and fluoride ion values).

$Fe^{3+}$ ion content of the bath: on preparing the bath, an $Fe^{3+}$ ion quantity of not less than 15 g/l is introduced into the pickling solution in the form of ferric sulphate. The function of this ion is to replace nitric acid as oxidizing agent in the reaction $2Fe^{3+}+Fe \rightarrow 3Fe^{2+}$, favoured by the bath pH conditions During the process the correct conditions for maximizing the ferric rather than ferrous form for the iron dissolved in the bath must be continuously created.

The oxidation of $Fe^{2+}$ ions to $Fe^{3+}$ ions during the process to maintain the concentration of these latter above the minimum predetermined value is achieved by the combined action of the air blown into the bath and the $H_2O_2$ added continuously to the bath in small quantities.

Continuous Addition of Stabilized Hydrogen Peroxide

For the process to be economical, the quantity of hydrogen peroxide consumed must be as small as possible. For this reason it is important to use hydrogen peroxide containing a known stabilizer effective in preventing or at least substantially retarding peroxide decomposition under the operation conditions (temperature up to 70° C., very acid bath pH, iron up to 100 g/l, presence of Ni and Cr ions). Stabilizers for $H_2O_2$ effective in acid medium are for instance: 8-hydroxyquinoline, sodium stannate, phosphoric acids, salycylic acid, pyridincarboxylic acid. As particularly suitable stabilizer came out p. hydroxy-benzoic acid and phenacetin (i.e. acetyl-p-phenetidine) and mixture of both compounds. These stabilizer are used in amount corresponding to 5÷20 p.p.m. in the pickling bath.

Because these stabilizers undergo a slow decomposition in the pickling bath a continuous or periodical addition of stabilizer to the bath is necessary.

This can be accomplished by using for the continuous or periodical addition of $H_2O_2$ a product containing little amount of stabilizer. The use of suitably stabilized $H_2O_2$ in combination with the use of air blown into the bath has resulted in a process in which the use of $H_2O_2$ is economically convenient, this never having been possible with known processes. The pickling bath is prepared with an $H_2O_2$ concentration of between 1 and 20 g/l, and preferably 2–5 g/l. During pickling, the continuous $H_2O_2$ feed is regulated on the basis of the type of steel to be pickled, the surface characteristics of the material (or semi-finished product), and the quantity and quality of scale resulting from rolling or annealing. Generally an $H_2O_2$ quantity of between 0.3 and 1 g/l of bath per hour of operation is fed.

Continuous Air Blowing

During pickling, a continuous air flow into the bath is maintained at a rate of at least 3 $m^3/m^3$ of bath per hour of operation. This air flow, if fed in at a suitable speed, contributes to good bath agitation, this being an important condition for effective pickling as it continuously disturbs the laminar layer in proximity to the surface to be treated, hence ensuring that this surface is always in direct contact with a fresh pickling solution. To ensure optimum mechanical agitation and homogenization of the treatment liquid it is advisable to blow the air into the bottom of the tank via perforated feed tubes, or by the use of suitable blowing equipment.

As already stated, the blown air also makes proper conditions to the oxidation of the ferrous ions by the hydrogen peroxide, so resulting in a considerable reduction in the consumption of this latter.

Control of Redox potential: it is well known that the behaviour of stainless steel in acid mixtures is characterised by polarization curves which present activity, passivity and transpassivity phases for different potentials, so that the bath must be kept under those conditions in which the material does not corrode, i.e. the process must be operated at a potential falling within the passivity range, which can be predetermined based on the type of steel.

During operation, as the concentration of the bivalent ferrous ion in the bath increases, the Redox potential of the bath tends to decrease, however the addition of hydrogen peroxide in combination with the oxidising action of the blown air returns it to optimum values, normally well in excess of 300 mV. By constantly controlling the potential it is therefore possible not only to ensure good material pickling but also to ensure that the passivation film forms on it. In this respect, industrial tests have resulted in all cases in bright, shiny and perfectly level surfaces on which no signs of any corrosive attack due for example to pitting or excessive pickling action were visible. In this respect it should be noted that often the traditional pickling process based on nitric acid and hydrofluoric acid results in such defects, and it is by no means rare for the traditional system to result in "burning" of the material (i.e. intercrystalline corrosion phenomena).

During those periods in which the pickling bath is not operating (weekend, nights), it is necessary only to provide minimum air blowing to maintain the Redox potential at optimum values, so making it possible to leave the material immersed in the solution for many hours without risk of attack.

Miscellaneous Additives Content of the Pickling Bath

In formulating the pickling bath according to the present invention, usual additives for this type of process are used, chosen from non-ionic surfactants and fluorinated surfactants acting as wetting agents, emulsifiers, brighteners and acid attack inhibitors. These additives, by mutual synergic action, improve and favour the pickling action. They are used in a total quantity of about 1 g/l of bath.

Particularly advantageous additives are perfluorinated anionic surfactants as well as non-ionic surfactants belonging to the polyethoxylated alkamol derivatives class containing 10 or more C atoms.

As acid attack inhibitor for the pickling bath can be used: dicyclohexylthiourea, alkylbenzyldialkylsulfonium salts, dialkylsulfides and dialkyl sulfoxide, monoethanolamine: many other inhibitors are disclosed by the publication "Corrosion inhibitors—Manufacture and Technology" of M. William Ranney, issued by Noyes data Corp. (1976) at pages 45–64.

Advantages of the Process

Absence of sludge: the process according to the invention reduces to a minimum or even prevents sludge formation with consequent further cost saving. This advantage is due inter alia to an appropriate HF concentration during the process and to proper control of the concentration of ferrous ions, which are immediately and adequately oxidized to ferric ions.

Facility for automatic control: the process can be constantly controlled by automatic equipment which on the basis of analytical measurements (free and total acid, free fluoride ion content, bivalent ferrous ion content, Redox potential) meter the quantities of pickling products and stabilized hydrogen peroxide to be fed to achieve correct operating parameters.

Process versatility: the process of the invention is easily adaptable to all industrial stainless steel treatment plants, requiring only modest modification. It is also suitable for treating articles and semifinished products of any type, including wife, rod, strip, plate and tubes, the treatment parameters (temperature, time, concentrations) being able to undergo variation without in any way prejudicing results.

The process is suitable for steel of any type: martensitic, ferritic, anstenitic.

The following examples are given merely to illustrate some applications of the process according to the invention.

EXAMPLE 1

Tests on an Industrial Plant, Processing Steel Rod 70 t of steel rod of average diameter 6 mm, equivalent to about 5000 $m^2$ of the following materials: AISI 303, AISI 304 L, AISI 304 K, AISI 304 K2, AISI 316 L, ATST 316 R, AISI 316 Ti and AISI 430, were treated in an industrial tank with a useful bath capacity of 5 $m^3$.

The initial pickling bath had the following composition:

172 g/l of $H_2SO_4$
48 g/l or HF
15 g/l of $Fe^{3+}$
5 g/l of $H_2O_2$ (containing stabilizer)
1 g/l of miscellaneous additives.

130 vol. hydrogen peroxide was used, containing 2 g/l of stabilizer. The hydrogen peroxide stabilizer was a mixture 1/1 of phenacetin and p.hydroxy-benzoic acid.

The additives consisted of non-ionic surfactants and acid attack inhibitors of known type for pickling baths.

The initially measured Redox potential was about 700 mV.

During the test, which lasted a total of 300 hours, stabilized hydrogen peroxide was added continuously at a rate of 1 g/l per hour of operation. $H_2SO_4$ was added at intervals to a total of 340 kg, as were HF to a total of 460 kg and additives of the aforesaid type to a total of 25 kg.

The bath temperature was maintained between 50° and 60° C. and the air flow at 30 $m^3$/h.

The treatment time varied between 40 end 75 minutes according to the type of steel treated, with pickling kinetics similar to if not in various cases better than those of the traditional process based on nitric acid and hydrofluoric acid, which was simultaneously compared in a parallel tank.

The Redox potential, measured periodically, remained between 350 and 450 mV, hence ensuring optimum surface finish of the material treated. On termination of treatment the total iron content was about 100 g/l with an $Fe^{3+}$ content of 60 g/l and an $Fe^{2+}$ content of 40 g/l.

In no case and on no material was there any surface pitting "burning".

On termination of treatment the formation of precipitate in the bath was found to be totally irrelevant and consisted mainly of graphite. No ferrous sulphate crystallization was found. The bath was found to still possess full pickling efficiency.

EXAMPLE 2

Industrial Tests on Strip and Plate

Tests were carried out on AISI 303, AISI 304 and AISI 316 strip and plate in an industrial plant using the process of the invention and the traditional process for comparison.

a) traditional process:

1st tank: electrolytic pickling with $H_2SO_4$—1 minute at 60°–70° C.

2nd tank: electrolytic pickling with $HNO_3$—1 minute at 60°–70° C.

3rd tank: pickling with $HNO_3$+HF—1 minute at 70° C.

b) process of the invention:

1st tank: preliminary electrolytic pickling with $H_2SO_4$—1 minute at 60°–70° C.

2nd tank: treatment for 1 minute at 50°–55° C. with a bath having the following initial composition:

150 g/l of $H_2SO_4$
48 g/l of HF
15 g/l of $Fe^{3+}$
5 g/l of $H_2O_2$ (130 vol.) containing the same stabilizer as in Example 1

1 g/l of miscellaneous additives (of the type indicated in the preceding example).

3rd tank: treatment fop 1 minute at 50°–55° C. with the same bath composition as the 2nd rank.

The useful bath capacity of the 2nd and 3rd tank was each 10,000 liters. During the test (lasting about 240 hours) 0.6 g/l of $H_2O_2$ per hour (stabilized as stated) was fed continuously into the bath of 2nd tank: the same amount of $H_2O_2$ was fed in 3rd tank. The Redox potential measured periodically remained between 320 and 340 mV in 2nd tank and 370–380 mV in 3rd tank. No further additions of other ingredients were made. The air flow was maintained at 30 $m^3/h$ to each tank, The total material treated in the test was 1800 t.

The surface appearance of the plate on termination of the process was always shiny and bright, and was better than that obtained with the traditional comparison test. There was no evidence of excess pickling or surface pitting on any material.

EXAMPLE 3

Laboratory Test on Tubes

Laboratory tests were carried out on AISI 304 and AISI 316 tubes under the bath conditions described under Example 1.

The ratio of the material quantity used to the test tank capacity was equal to that of normal industrial cycles. The temperature was fixed at 50° C. and the treatment time varied from 30 to 60 minutes depending on the type of material.

The progress of the test and the results obtained were similar to those described under Example 1, with regard to product consumption, to the behaviour of the Redox potential, to the final surface appearance of the material, to the attack kinetics and to the absence of any pitting phenomena.

CONCLUSIONS of the industrial scale trials.

From the aforegoing it is apparent that the new stainless steel pickling and passivation process, characterised by a bath of specific composition, control of the bath during the entire operation, in particular of its Redox potential, and continuous air blowing, represents an optimum solution in terms of the technical result of the treatment, process economy (in particular due to the low $H_2O_2$ consumption), and the pollution problem posed by traditional nitric acid processes.

I claim:

1. A process for pickling and passivating stainless steel, said process consisting of contacting the material to be treated with a bath maintained at a temperature of between 30° and 70° C. and preferably between 45° and 55° C. and having the following initial composition:

a) $H_2SO_4$ at least 150 g/l b) $Fe^{3+}$ at least 15 g/l c) HF at least 40 g/l d) $H_2O_2$ 1–20 and preferably 2–5 g/l e) additives of the non-ionic surfactant type acid attack inhibitor type about 1 g/l in total; continuously feeding into said bath:

an air flow of at least 3 $m^3/h$ per $m^3$ of bath, using a suitable distributor device for diffusing the flow into the liquid mass;

a quantity of stabilized $H_2O_2$ of between 0.3 and 1 g/l per hour, controlled on the basis of the Redox potential of the bath, which must be maintained at $\geqq 350$ mV;

and possibly sufficient quantities of ingredients a), c) and e) to maintain their concentration in the bath at optimum levels and the bath pH between 0 and 0.5.

2. A process as claimed in claim 1, wherein the $Fe^{3+}$ ions are introduced into the initial bath in the form of ferric sulphate.

3. A process as claimed in claim 1, wherein a bath is used of initial composition:

172 g/l of $H_2SO_4$ 48 g/l of HF 15 g/l of $Fe^{3+}$ 5 g/l of $H_2O_2$ containing stabilizer 1 g/l of non-ionic surfactant and acid attack inhibitor additives.

4. A process as claimed in claim 1, conducted in combination with preliminary partial removal of oxides by a known process.

5. A process as claimed in claim 1 wherein at least 170 g/l of $H_2SO_4$ is employed.

* * * * *